US009882306B2

(12) United States Patent
Pao et al.

(10) Patent No.: US 9,882,306 B2
(45) Date of Patent: Jan. 30, 2018

(54) CABLE CONNECTOR AND CARRIER MODULE THEREOF

(71) Applicant: TOPCONN ELECTRONIC (KUNSHAN) CO., LTD, Suzhou, Jiangsu Province (CN)

(72) Inventors: Chung-Nan Pao, New Taipei (TW); Yu-Hsiung Lin, New Taipei (TW); Yi-Guang Lai, New Taipei (TW); Ming-Chun Hsu, New Taipei (TW); Kai Wu, Guangdong (CN)

(73) Assignee: TOPCONN ELECTRONIC (KUNSHAN) CO., LTD, Suzhou, Jiangsu Province (CN)

( * ) Notice: Subject to any disclaimer, the term of this patent is extended or adjusted under 35 U.S.C. 154(b) by 0 days.

(21) Appl. No.: 15/203,898

(22) Filed: Jul. 7, 2016

(65) Prior Publication Data

US 2017/0294739 A1 Oct. 12, 2017

(30) Foreign Application Priority Data

Apr. 12, 2016 (CN) ..... 2016 2 0301557 U

(51) Int. Cl.
*H01R 13/58* (2006.01)
*H01R 12/53* (2011.01)
*H01R 13/26* (2006.01)

(52) U.S. Cl.
CPC ..... *H01R 13/5804* (2013.01); *H01R 12/53* (2013.01); *H01R 13/26* (2013.01)

(58) Field of Classification Search
CPC ..... H01R 13/5804
USPC ..... 439/460
See application file for complete search history.

(56) References Cited

U.S. PATENT DOCUMENTS

RE36,845 E * 8/2000 Huppenthal ..... H01R 12/775 333/260
6,447,326 B1 * 9/2002 Teach ..... H01R 13/6658 439/460
8,011,950 B2 * 9/2011 McGrath ..... H01R 12/594 439/497
8,840,432 B2 * 9/2014 Alden, III ..... H01R 13/648 439/607.35
9,166,320 B1 * 10/2015 Herring ..... H01R 12/79
(Continued)

*Primary Examiner* — Abdullah Riyami
*Assistant Examiner* — Nader Alhawamdeh
(74) *Attorney, Agent, or Firm* — Li & Cai Intellectual Property (USA) Office

(57) ABSTRACT

A carrier module of a cable connector includes a circuit board and a connecting clip clamping the circuit board. The circuit board has a first surface and a second surface. The connecting clip has a clamping portion and a plurality of positioning arms. The clamping portion has a connecting sheet and two clamping sheets curvedly extended from the connecting sheet. The clamping sheets are respectively abutted against the first and second surfaces. The positioning arms are respectively connected to the clamping sheets and respectively arranged at two opposite sides of the clamping portion. The positioning arms are respectively configured to fix a plurality of cables disposed on the clamping sheets. Thus, the carrier module of the instant disclosure provides a positioning effect for the cables by the connecting clip fixed firmly on the circuit board with good common grounding performance. Besides, the instant disclosure also provides a cable connector.

17 Claims, 15 Drawing Sheets

(56) References Cited

U.S. PATENT DOCUMENTS

| | | | | |
|---|---|---|---|---|
| 9,203,193 | B2 * | 12/2015 | Hackman | H01R 13/648 |
| 9,257,797 | B2 * | 2/2016 | Kuang | H01R 9/038 |
| 9,306,334 | B2 * | 4/2016 | Zhu | H05K 1/0219 |
| 2012/0064779 | A1 * | 3/2012 | Wu | H01R 9/032 439/676 |
| 2012/0190217 | A1 * | 7/2012 | Tseng | H01R 9/034 439/55 |
| 2014/0191457 | A1 * | 7/2014 | Sharma | H05K 3/301 269/37 |
| 2014/0220798 | A1 * | 8/2014 | Putt, Jr. | H01R 13/652 439/95 |
| 2016/0294122 | A1 * | 10/2016 | Janssen | H01R 9/034 |

* cited by examiner

CABLE CONNECTOR AND CARRIER MODULE THEREOF

BACKGROUND OF THE INVENTION

1. Field of the Invention

The instant invention relates to a connector and, in particular, to a cable connector and a carrier module thereof.

2. Description of Related Art

The conventional cable connector includes a circuit board, a plurality of cables, and a positioning member. One end of each cable is welded on a surface of the circuit board, and an edge of the positioning member is welded on the surface of the circuit board to press the cables, such that the cables are clamped by the circuit board and the positioning member. However, the edge of the positioning member is fixed on the surface of the circuit board by using spot welding merely, so the connection between the positioning member and the circuit board is unstable. Accordingly, when any cable and the circuit board are pulled to generate a shearing force, the positioning member is easily separated from the surface of the circuit board because of the shearing force.

SUMMARY OF THE INVENTION

The instant disclosure provides a cable connector and a carrier module thereof for effectively solving the problems generated from the conventional cable connector.

The instant disclosure provides a cable connector, comprising: a circuit board having a first surface and an opposite second surface; a connecting clip clamping the circuit board and comprising: a clamping portion including a connecting sheet and two clamping sheets curvedly extended from the connecting sheet, wherein the two clamping sheets respectively abut against the first surface and the second surface; and a plurality of positioning arms respectively connected to the two clamping sheets and respectively arranged at two opposite sides of the clamping portion; and a plurality of conductive cables each comprising: a metallic wire having an exposed segment and an embedded segment; an isolation layer covering the embedded segment; a metallic shielding layer covering the isolation layer, wherein the exposed segment is arranged out of the isolation layer and the metallic shielding layer; wherein the exposed segments of the conductive cables are respectively fixed on the first surface and the second surface, the metallic shielding layers of the conductive cables are respectively abutted against the two clamping sheets and are respectively positioned with the positioning arms, and the connecting clip is configured to electrically connect the metallic shielding layers to each other.

The instant disclosure also provides a carrier module of a cable connector, comprising: a circuit board having a first surface and an opposite second surface; and a connecting clip clamping the circuit board and comprising: a clamping portion including a connecting sheet and two clamping sheets curvedly extended from the connecting sheet, wherein the two clamping sheets respectively abut against the first surface and the second surface; and a plurality of positioning arms respectively connected to the two clamping sheets and respectively arranged at two opposite sides of the clamping portion, wherein the positioning arms are configured to position a plurality of conductive cables provided on the two clamping sheets.

In summary, the connecting clip of the cable connector in the instant disclosure is fixed on the circuit board by a clamping force generated from the construction thereof, so the connection of the circuit board and the connecting clip can effectively resist a shearing force when any conductive cable and the circuit board are pulled.

Moreover, the connecting clip is configured to electrically connect the metallic shielding layers of the conductive cables to each other, thereby enhancing a high-frequency transmission performance of the cable connector.

In addition, the construction of the cable connector in the instant disclosure is formed by using the connecting clip to clamp the circuit board, and the conductive cables are respectively arranged adjacent to the positioning arms, so that the carrier module of the instant disclosure can provide a better positioning effect for the conductive cables.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

[First Embodiment]

Figure 1:
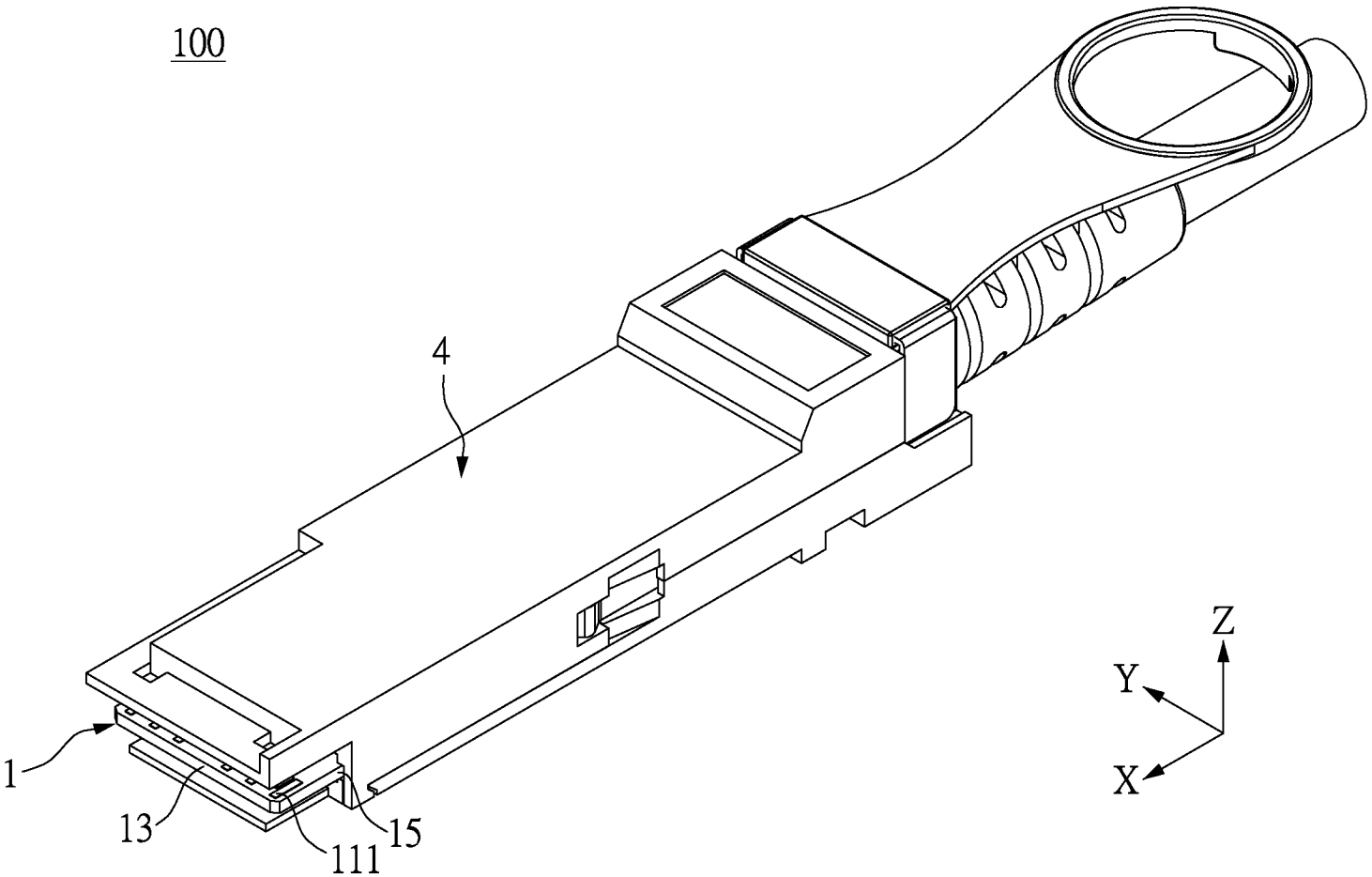
FIG. 1 is a perspective view showing a cable connector according to a first embodiment of the instant disclosure.

Please refer to FIGS. 1 through 10, which show a first embodiment of the instant disclosure. References are hereunder made to the detailed descriptions and appended drawings in connection with the instant invention. However, the appended drawings are merely shown for exemplary purposes, rather than being used to restrict the scope of the instant invention.

Please refer to FIGS. 1 through 4, which show a cable connector 100 of the instant embodiment including a circuit board 1, a connecting clip 2, a plurality of conductive cables 3, and a case 4 receiving the circuit board 1, the connecting clip 2, and the conductive cables 3. A front end portion of the circuit board 1 is exposed from the case 4. The conductive cables 3 are positioned on a rear end portion of the circuit board 1 by using the connecting clip 2.

FIGS. 2 through 10 do not show the case 4 in order to more clearly show the inner construction of the cable connector 100, and each figure shows an axis X, an axis Y, and an axis Z, which are perpendicular to each other, to easily show the relative position and direction of the elements of the cable connector 100. In the instant embodiment, the axis X is parallel to a length direction of the circuit board 1, the axis Y is parallel to a width direction of the circuit board 1, and the axis Z is parallel to a thickness direction of the circuit board 1.

Figure 2:
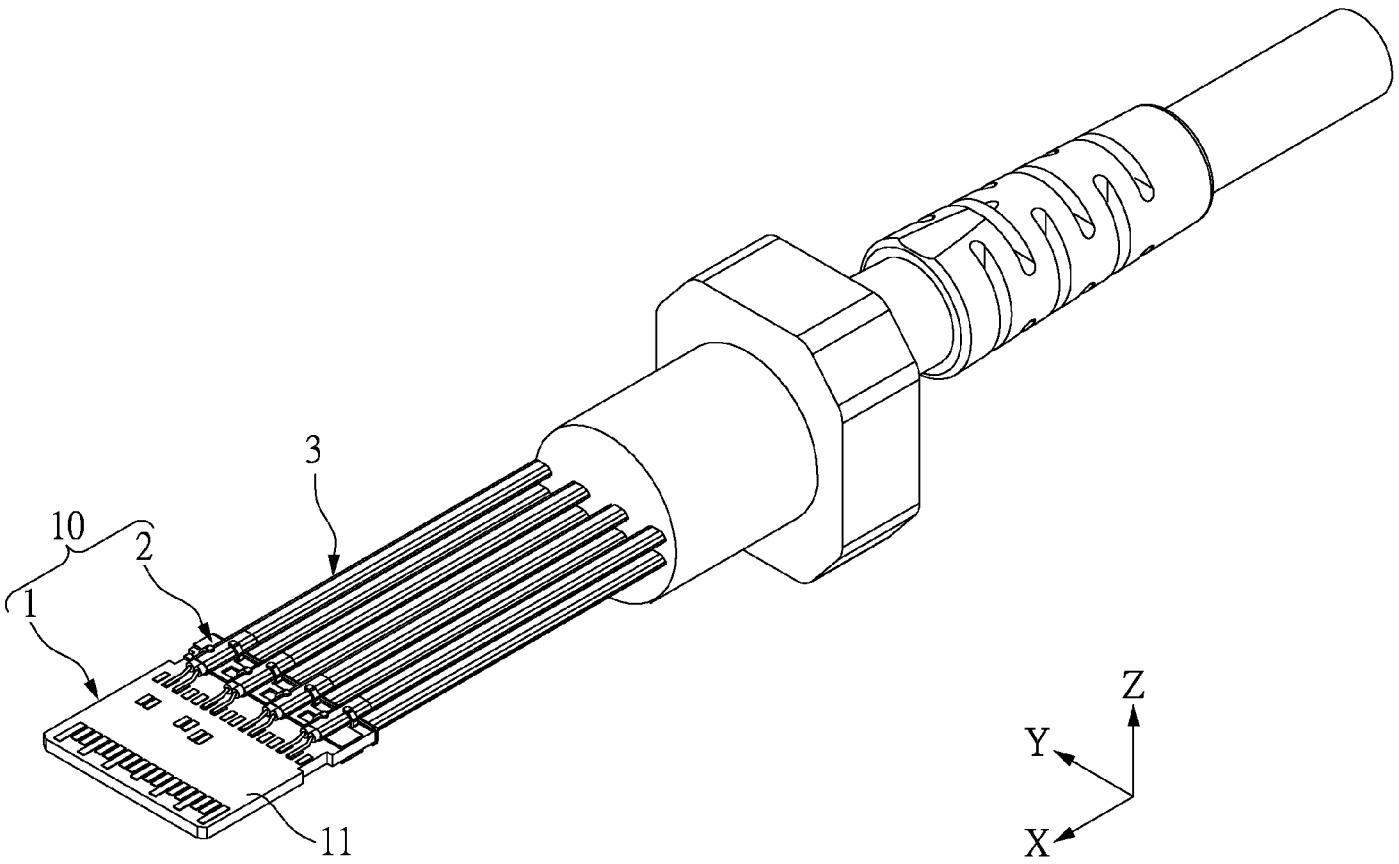
FIG. 2 is a perspective view of FIG. 1 as the case is omitted

It should be noted that the circuit board 1 and the connecting clip 2 can be defined as a carrier module 10 of the cable connector 100 (as shown in FIG. 2) and are configured to clamp and position the conductive cables 3.

Figure 3:
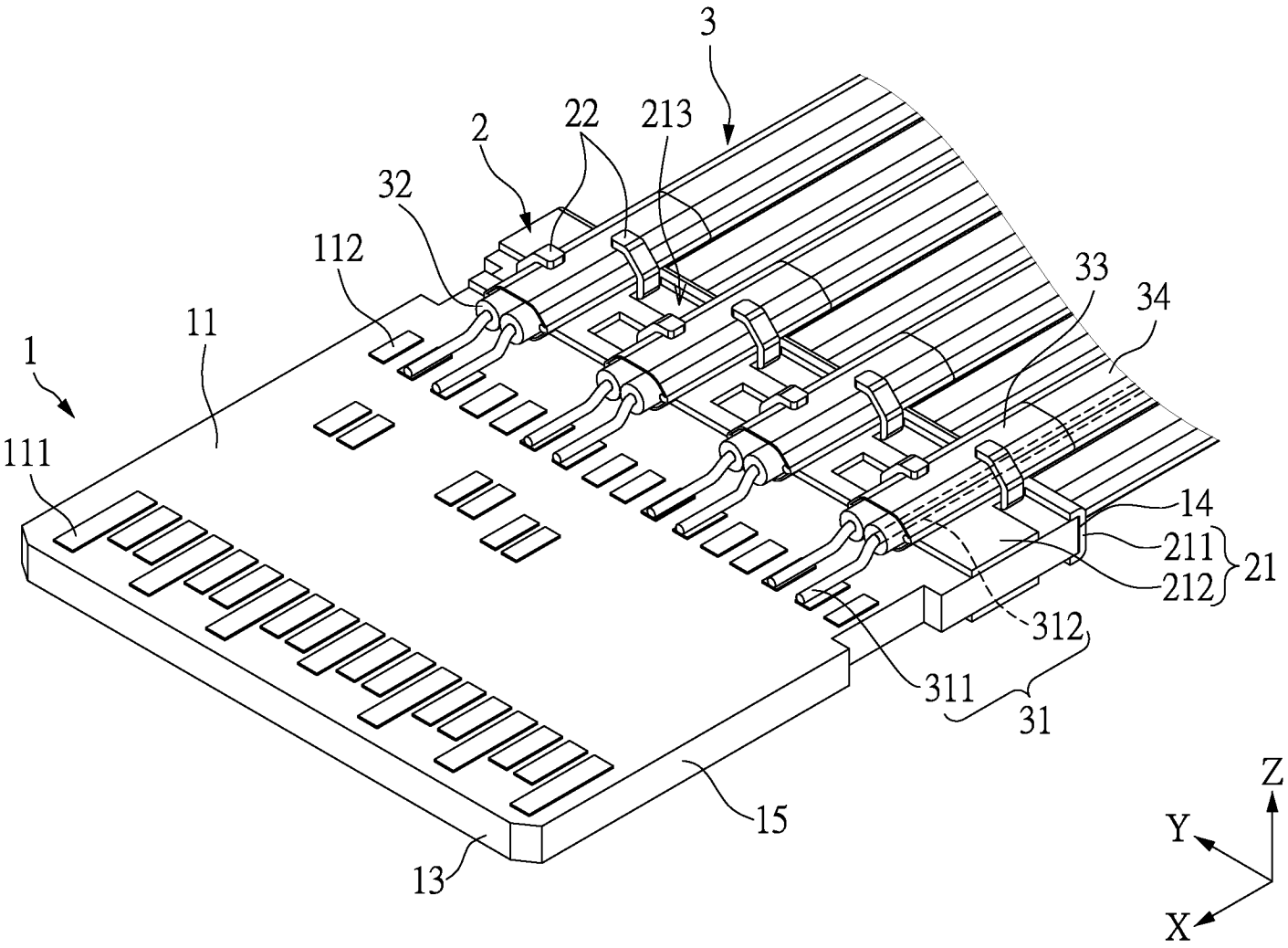
FIG. 3 is an enlarged view of FIG. 2.
Figure 4:
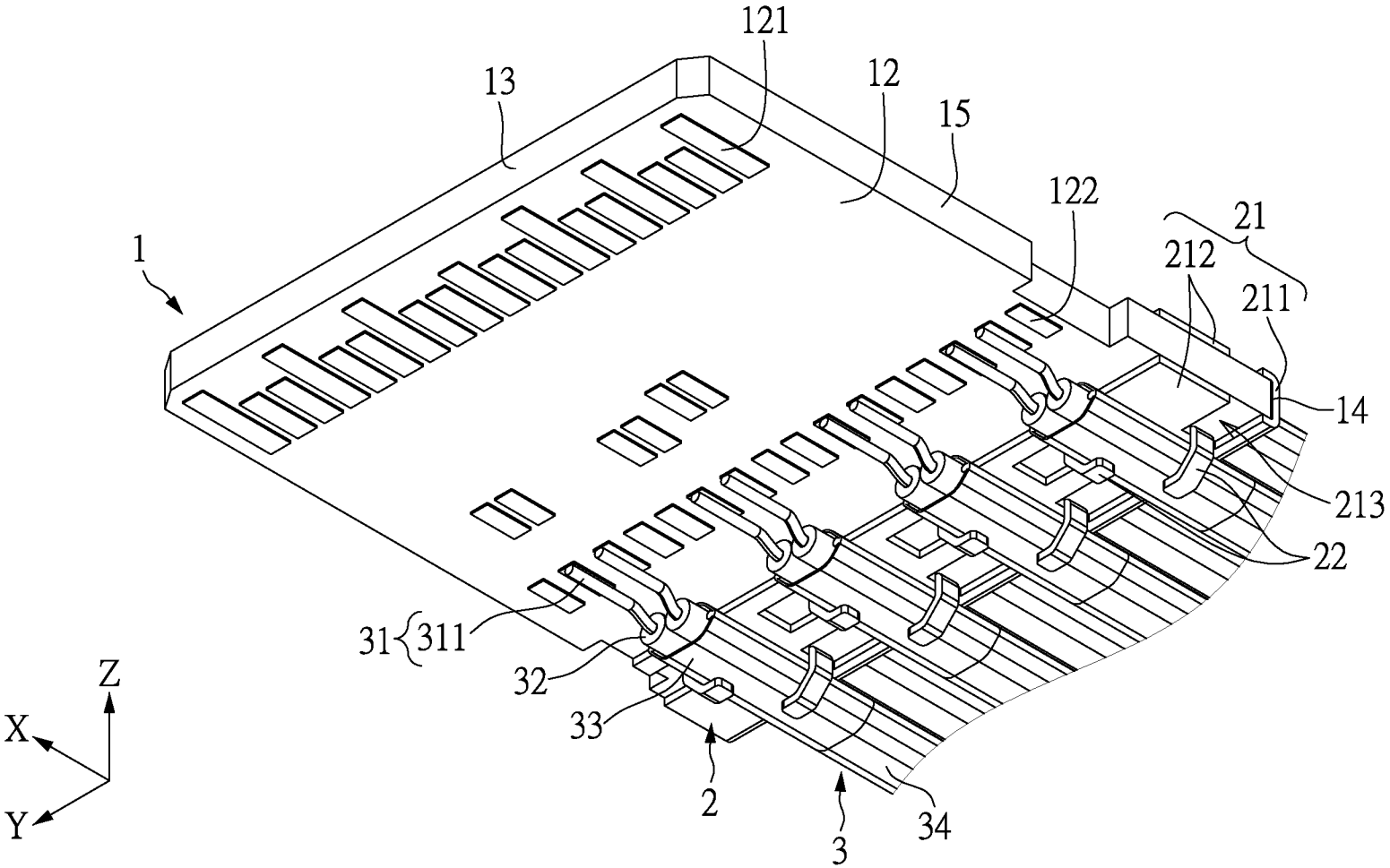
FIG. 4 is an enlarged view of FIG. 2 from another perspective.

As shown in FIGS. 3 and 4, the circuit board 1 having a rectangular shape includes a first surface 11 and an opposite second surface 12, a front edge 13 and a rear edge 14, and two side edges 15 arranged at two opposite edges thereof Each of the first surface 11 and the second surface 12 has a plurality of touching pads 111, 121 arranged in a row parallel to the axis Y. The touching pads 111, 121 are arranged adjacent to the front edge 13 of the circuit board 1 for electrically connecting to a mating connector (not shown), which is inserted into the cable connector 100. Each of the first surface 11 and the second surface 12 has a plurality of welding pads 112, 122 arranged in a row parallel to the axis Y. The welding pads 112, 122 are arranged adjacent to the rear edge 14 of the circuit board 1 for connecting to the conductive cables 3 by welding. Moreover, the welding pads 112, 122 connected to the conductive cables 3 are respectively and electrically connected to the touching pads 111, 121 by at least one circuit layer (not shown) embedded in the circuit board 1, so that the conductive cables 3 can transmit signal or power to the mating connector by using the circuit board 1. In addition, the welding pads 112, 122 in the instant embodiment are in an equidistant arrangement, but the arrangement and number of the welding pads 112, 122 can be adjusted according to the conductive cables 3.

Figure 5:
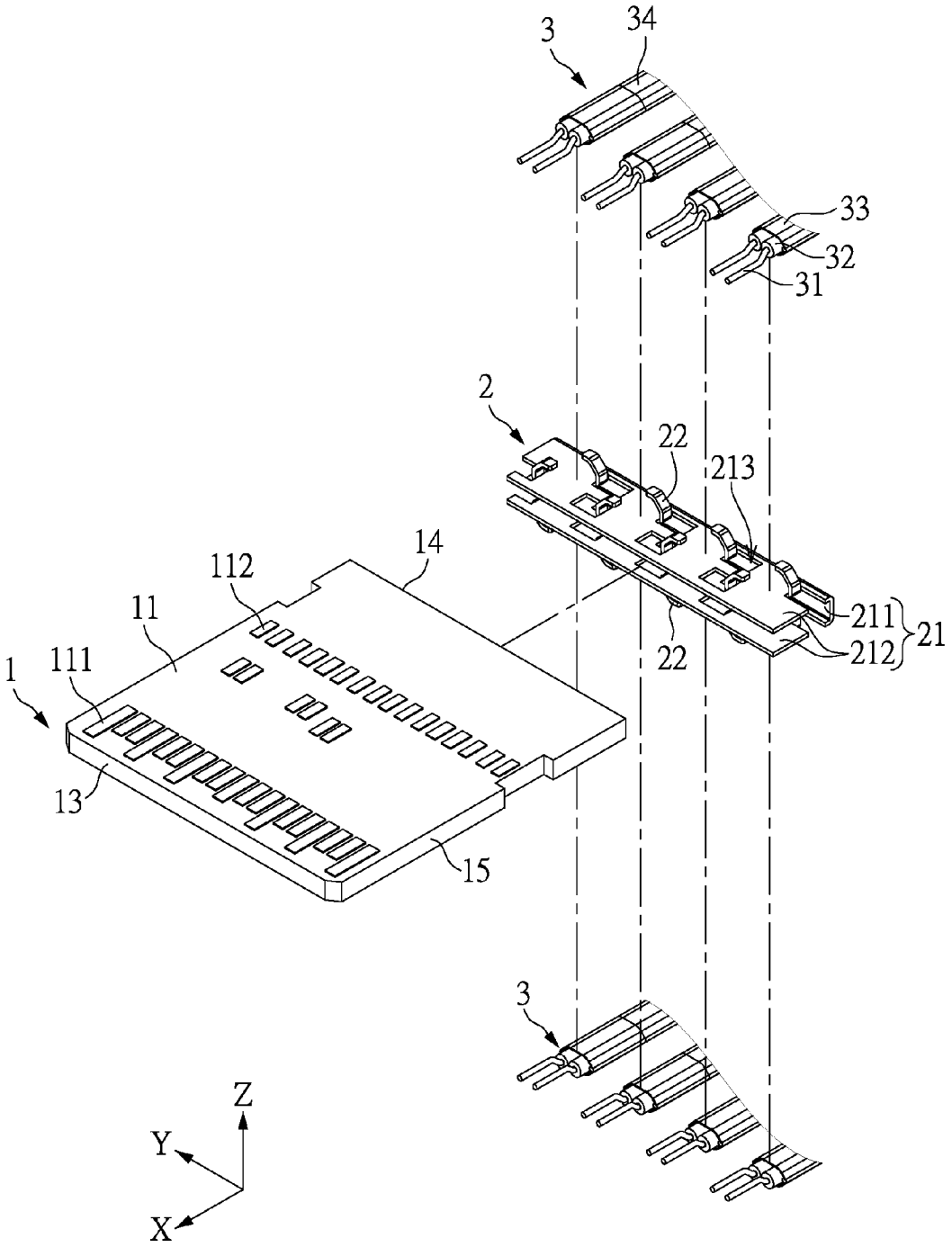
FIG. 5 is an exploded view of FIG. 3.
Figure 6:
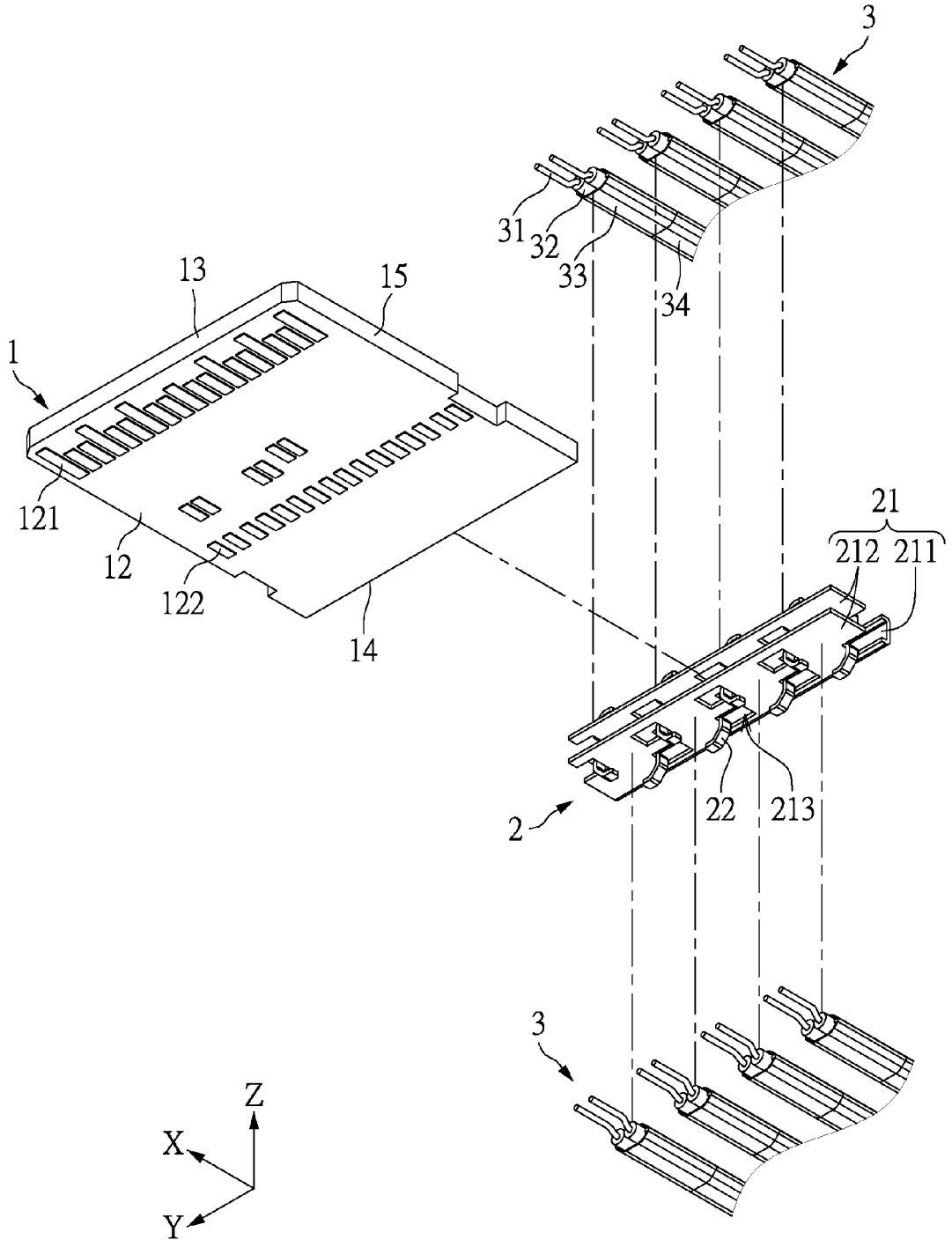
FIG. 6 is an exploded view of FIG. 4.

As shown in FIGS. 5 and 6, the connecting clip 2 in the instant embodiment is integrally formed and is made of an electrically conductive material (e.g., copper). The connecting clip 2 includes a clamping portion 21 having a U-shaped cross-section and a plurality of positioning arms 22 connected to the clamping portion 21. The clamping portion 21 has a connecting sheet 211 and two elongated clamping sheets 212 curvedly extended from the connecting sheet 211. The two clamping sheets 212 are respectively and perpendicularly connected to two opposite edges of the connecting sheet 211. The positioning arms 22 are respectively connected to the two clamping sheets 212 and are respectively arranged at two opposite sides of the clamping portion 21 (i.e., the upper side and the lower side of the two clamping sheets 212 in the axis Z shown in FIG. 5). Specifically, each of the two clamping sheets 212 has a plurality of inner walls, which respectively define a plurality of notches 213. The positioning arms 22 are respectively, curvedly, and outwardly extended from the inner walls of the two clamping sheets 212. The positioning arms 22 connected to each clamping sheet 212 are arranged in two rows, and each row of the positioning arms 22 is parallel to the axis Y. On each clamping sheet 212, one of the two rows of the positioning arms 22 is curvedly and outwardly extended from the corresponding inner walls in a first direction (i.e., the front row of the positioning arms 22 are approximately extended rightward shown in FIG. 3), and the other row of the positioning arms 22 is curvedly and outwardly extended from the corresponding inner walls in a second direction opposing to the first direction (i.e., the rear row of the positioning arms 22 are approximately extended leftward shown in FIG. 3).

Moreover, as shown in FIGS. 3 and 5, the connecting clip 2 clamps the circuit board 1, the two clamping sheets 212 respectively abut against the first surface 11 and the second surface 12, and an inner surface of the connecting sheet 211 is arranged to face the rear edge 14 of the circuit board 1. The inner surface of the connecting sheet 211 and an inner surface of each clamping sheet 212 in the instant embodiment entirely abut against an outer surface of the circuit board 1 (i.e., the rear edge 14, the first surface 11, and the second surface 12 of the circuit board 1), but the instant disclosure is not limited thereto. Specifically, the connecting clip 2 in the instant embodiment is configured, without welding, to each of the first surface 11 and the second surface 12 of the circuit board 1. A portion of the first surface 11 abutted against the corresponding clamping sheet 212 is arranged between the row of the welding pads 112 of the first surface 11 and the rear edge 14 of the circuit board 1, and a portion of the second surface 12 abutted against the corresponding clamping sheet 212 is arranged between the row of the welding pads 122 of the second surface 12 and the rear edge 14 of the circuit board 1.

Figure 9:
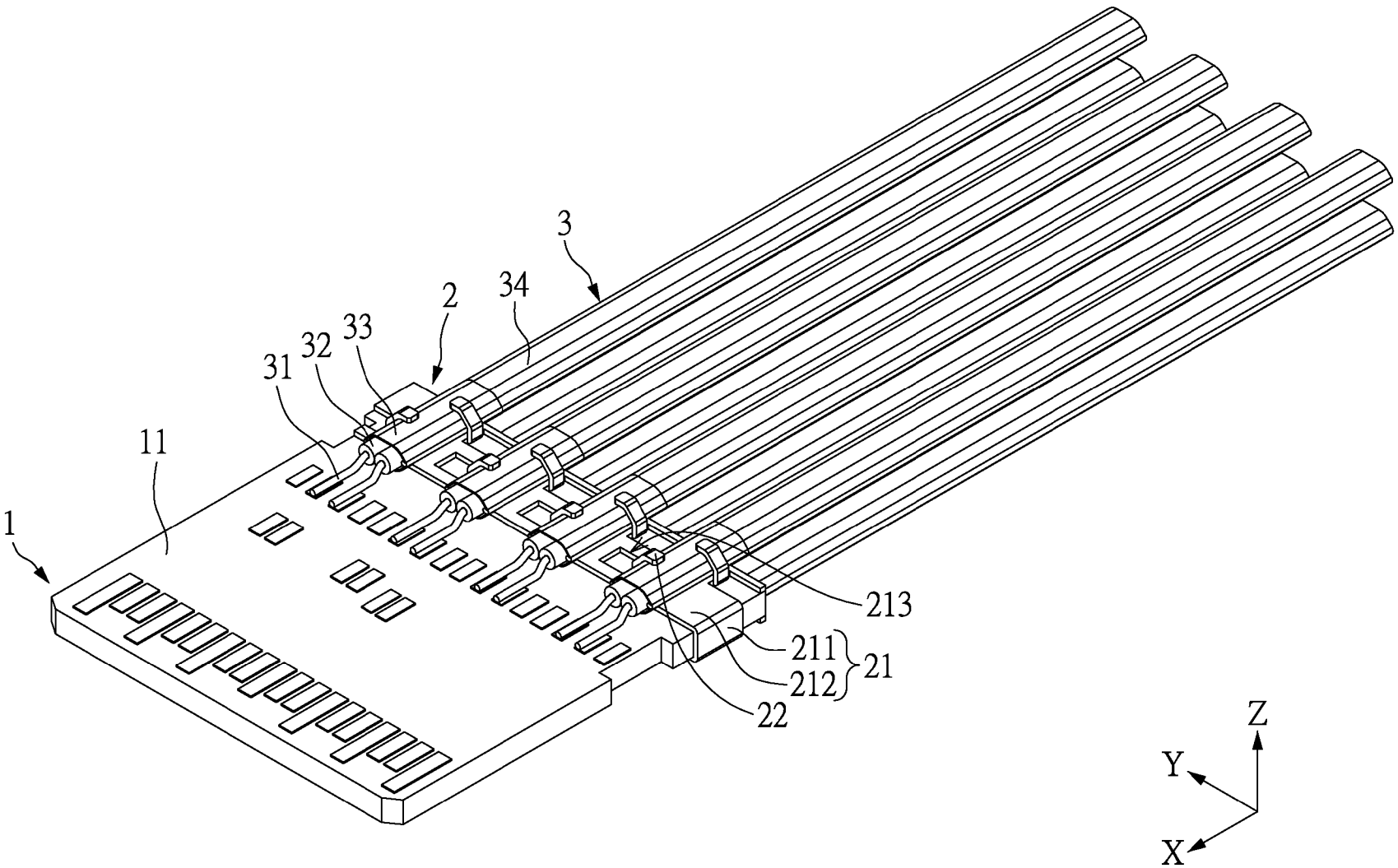
FIG. 9 is a perspective view showing a variety of the cable connector of the first embodiment, which has a connecting sheet of the connect clip disposed on a side edge of the circuit board.

In addition, the inner surface of the connecting sheet 211 shown in FIG. 5 is provided to face the rear edge 14 of the circuit board 1, but the instant disclosure is not limited thereto. For example, as shown in FIG. 9, the inner surface of the connecting sheet 211 can be configured to face one of the two side edges 15 of the circuit board 1.

Please refer to FIGS. 3 through 6. The conductive cables 3 are substantially the same, so this paragraph discloses one of the conductive cables 3 as an example. The conductive cable 3 includes two metallic wires 31, an isolation layer 32, a metallic shielding layer 33, and an insulation layer 34. Each metallic wire 31 has an exposed segment 311 and an embedded segment 312 (as shown in FIG. 3), and the isolation layer 32 is made of an insulating material and covers the embedded segments 312 of the two metallic wires 31 to separate the two metallic wires 31 from each other. The metallic shielding layer 33 covers the isolation layer 32. The exposed segments 311 of the two metallic wires 31 are arranged out of the isolation layer 32 and the metallic shielding layer 33. The insulation layer 34 covers part of the metallic shielding layer 33, in other words, the insulation layer 34 does not cover the portion of the metallic shielding layer 33 near to the exposed segments 311.

In addition, each conductive cable 3 in the instant embodiment has two metallic wires 31, and each metallic wire 31 is a single core wire, but the instant disclosure is not limited thereto. For example, in a non-shown embodiment, each conductive cable 3 can be provided with only one metallic wire 31 or three or more metallic wires 31, and each metallic wire 31 can be a multi-core wire. Each metallic wire 31 and each metallic shielding layer 33 in the instant embodiment can be made of copper, aluminum, or other conductive material. Each isolation layer 32 and each insulation layer 34 in the instant embodiment can be made of PVC, PE, rubber, or other insulating material.

The conductive cables 3 are respectively positioned on the first surface 11 and the second surface 12 of the circuit board 1, and the exposed segments 311 are respectively welded on the welding pads 112 of the first surface 11 and the welding pads 122 of the second surface 12. The metallic shielding layers 33 of the conductive cables 3 are respectively abutted against the two clamping sheets 212 and are respectively positioned by using the positioning arms 22. Specifically, each metallic shielding layer 33 is engaged with and positioned on the two rows of the positioning arms 22 of the corresponding clamping sheet 212 (e.g., each metallic shielding layer 33 is engaged with and positioned on one positioning arm 22 of each row of the positioning arms 22 of the corresponding clamping sheet 212). In other words, on each clamping sheet 212, one row of the two rows of the positioning arms 22 is respectively corresponding to the other row of the positioning arms 22, and any two corresponding positioning arms 22 arranged in different rows clamp one of the metallic shielding layers 33. Thus, the connecting clip 2 is configured to electrically connect the metallic shielding layers 33 disposed on the first surface 11 and the second surface 12 with each other.

Figure 7:
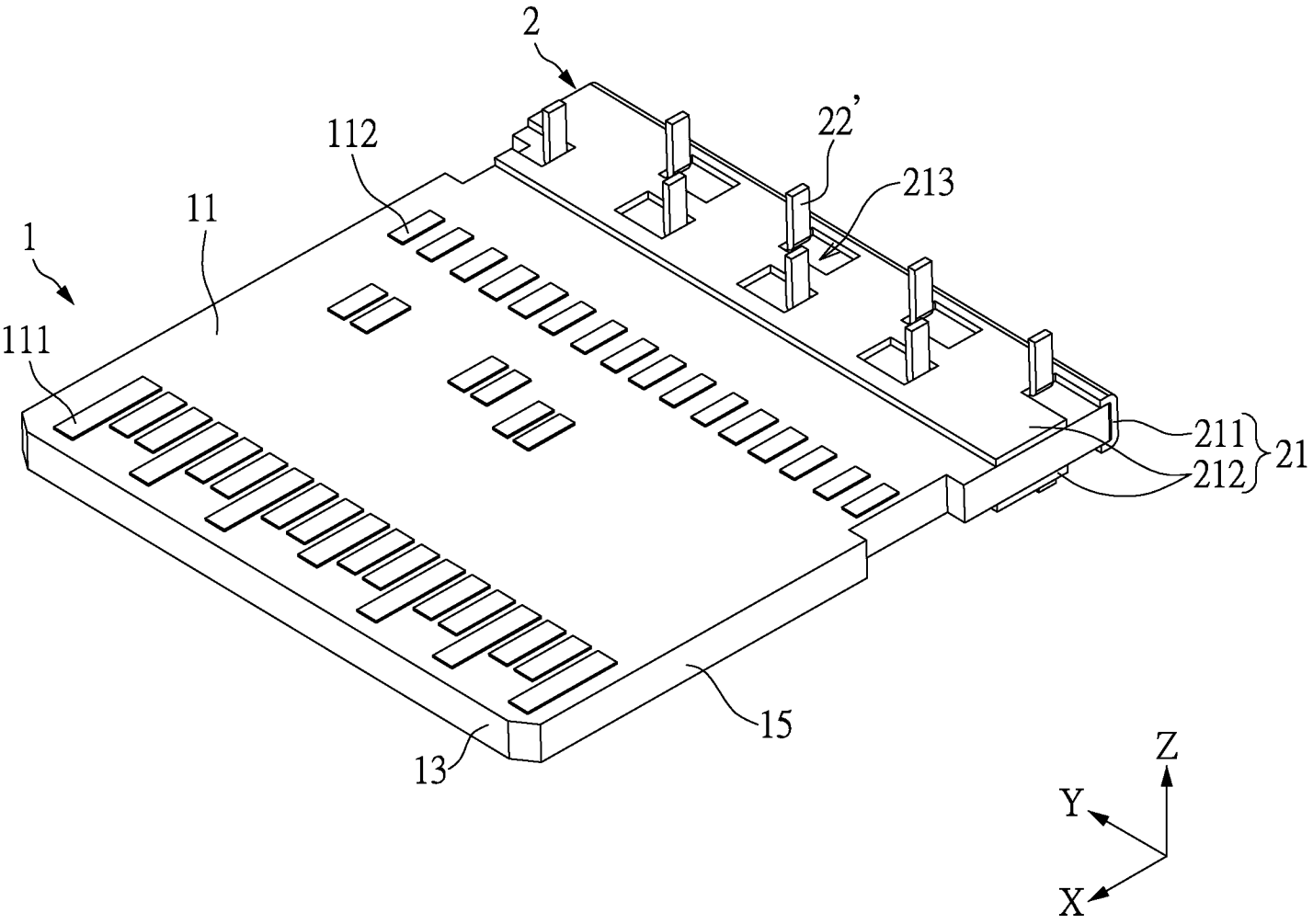
FIG. 7 is a perspective view showing a carrier module of the cable connector.
Figure 8:
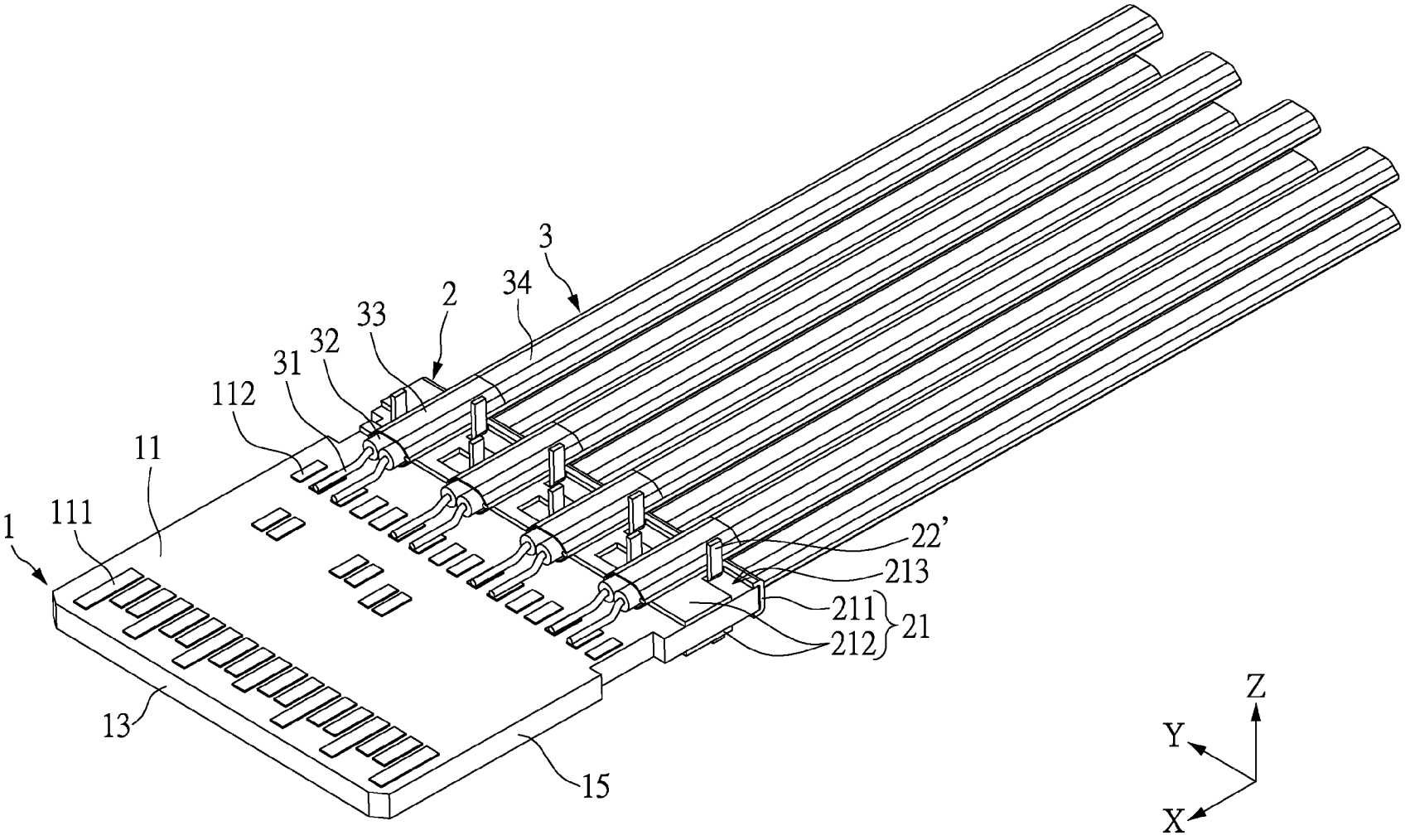
FIG. 8 is a perspective view showing the carrier module and the cables disposed on the carrier module.

Specifically, each positioning arm 22 shown in FIG. 5 has a J-shape, but each positioning arm 22' shown in FIG. 7 is provided with a straight shape before engaging with the metallic shielding layer 33. That is to say, after the connecting clip 2 clamps the circuit board 1, each positioning arm 22' is perpendicular to the circuit board 1. The exposed segments 311 of the conductive cables 3 are welded on the circuit board 1 and the metallic shielding layers 33 are respectively disposed on the clamping sheets 212 (as shown in FIG. 8), and then each positioning arm 22' is bent in a direction away from the corresponding inner wall (or notch 213) to form a J-shaped positioning arm 22 for engaging with the corresponding metallic shielding layer 33 (as shown in FIG. 9). A free end of each positioning arm 22 is preferably welded on the corresponding metallic shielding layer 33, but is not limited thereto.

Accordingly, the construction of the cable connector 100 in the instant embodiment is formed by using the connecting clip 2 to clamp the circuit board 1, and then the conductive cables 3 are respectively arranged adjacent to the positioning arms 22', so that the carrier module 10 of the instant embodiment provides a better positioning effect for the conductive cables 3 compared to the conventional cable connector.

Figure 10:
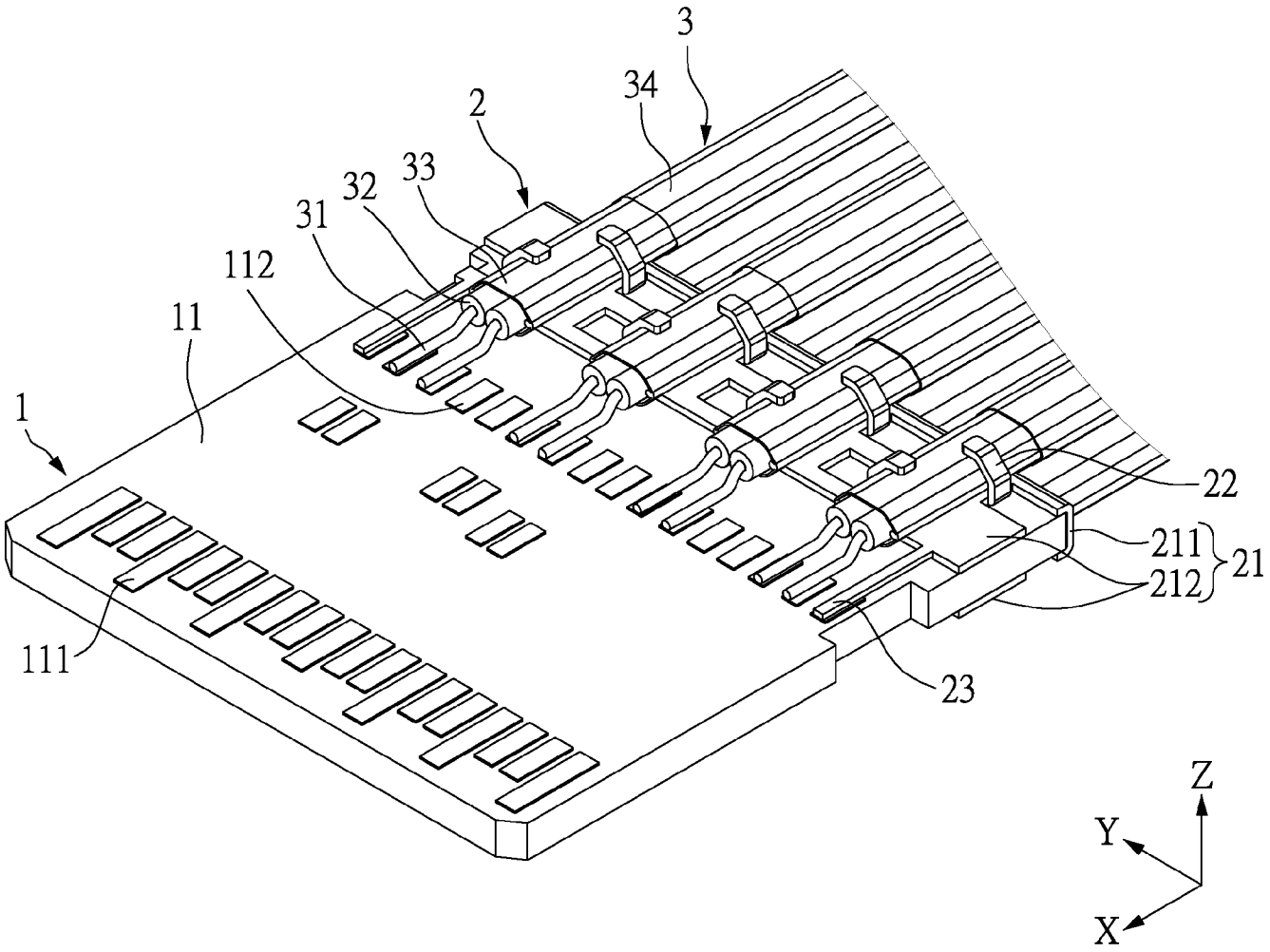
FIG. 10 is a perspective view showing a variety of the cable connector of the first embodiment, which has at least one extending arm of the connect clip welded on the circuit board.

The connecting clip 2 engages with the conductive cables 3 by using the positioning arms 22, and the conductive cables 3 are electrically connected to each other by using the connecting clip 2. Moreover, the connecting clip 2 is fixed on the circuit board 1 by a clamping force generated from the construction thereof, and the clamping force can be increased or decreased according to the designer's demand, so that the connection of the circuit board 1 and the connecting clip 2 can effectively resist a shearing force when any of the conductive cables 3 or the circuit board 1 are pulled. The connecting clip 2 in the instant embodiment can be configured, without welding, to each of the first surface 11 and the second surface 12 of the circuit board 1. That is to say, the connecting clip 2 can also be provided for selectively welding to the welding pads 112, 122 of the circuit board 1 according to the designer's demand, but the conventional positioning members are fixed on the circuit board only by welding. As shown in FIG. 10, the connecting clip 2 can be provided to weld on the welding pads 112, 122 of the circuit board 1 by two extending arms 23 extended from the clamping portion 21.

[Second Embodiment]

Figure 11:
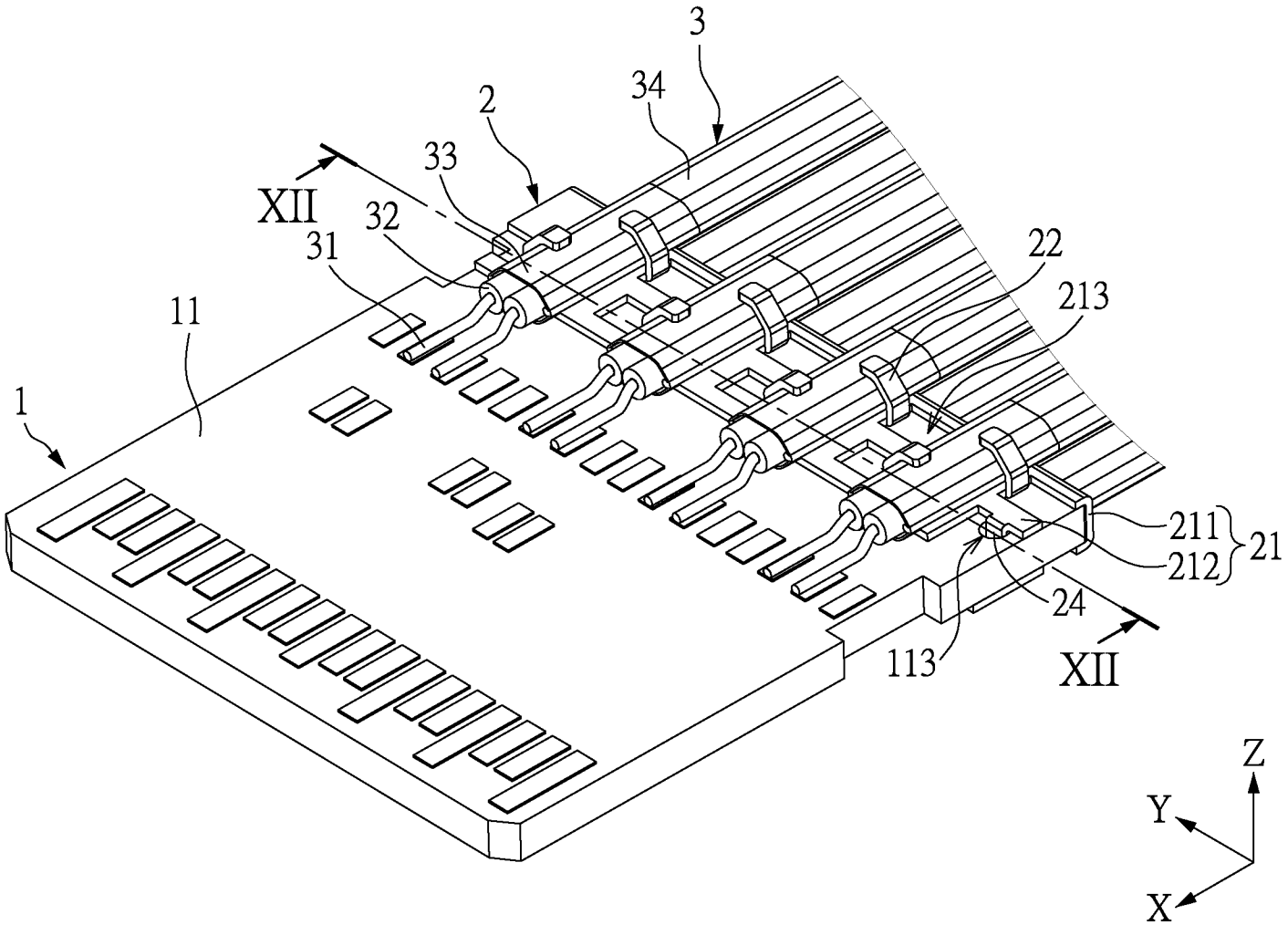
FIG. 11 is a perspective view showing a cable connector according to a second embodiment of the instant disclosure.
Figure 12:
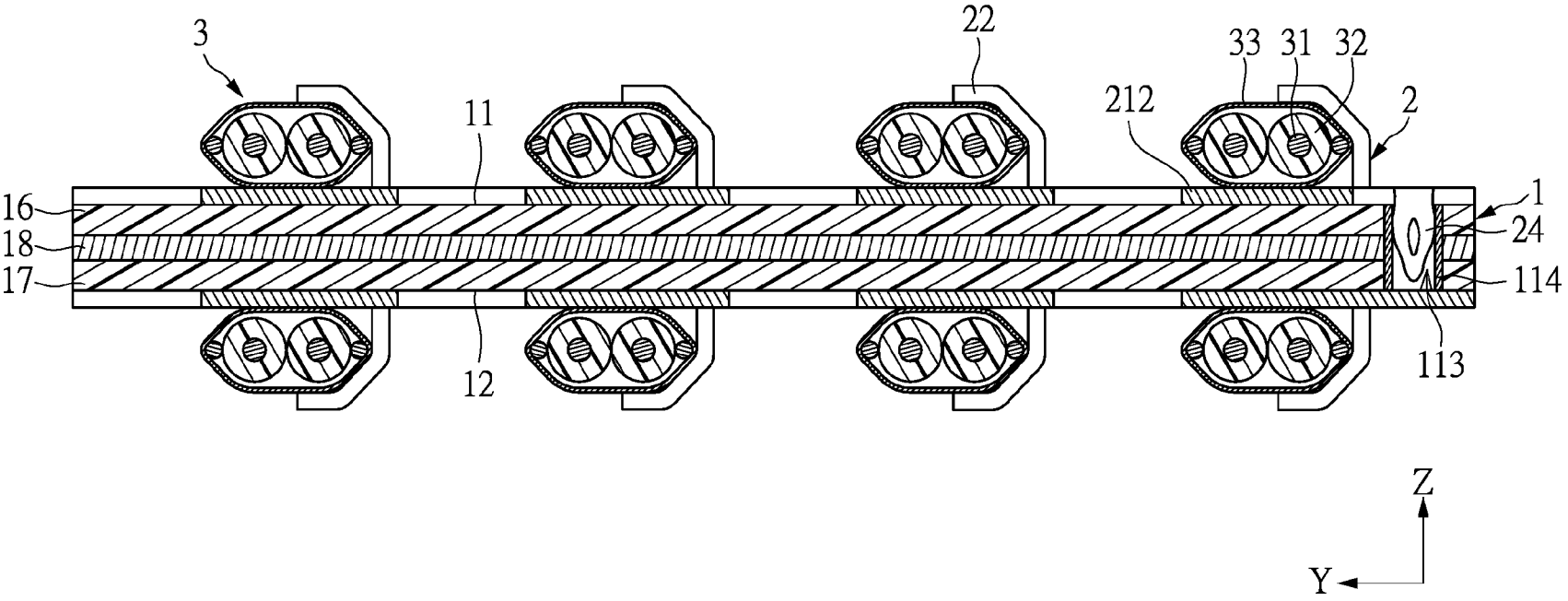
FIG. 12 is a cross-sectional view of FIG. 11 along a cross-sectional line XII-XII.

Please refer to FIGS. 11 and 12, which show a second embodiment. The second embodiment is similar to the first embodiment, the different features between the two embodiments being the construction of the connecting clip 2 and the corresponding portion of the circuit board 1.

Specifically, the circuit board 1 is a multi-layer construction and includes a first insulating layer 16, a second insulating layer 17, and a grounding layer 18 arranged between the first insulating layer 16 and the second insulating layer 17. The first surface 11 in the instant embodiment includes an outer surface of the first insulating layer 16, the touching pads 111, and the welding pads 112. The second surface 12 in the instant embodiment includes an outer surface of the second insulating layer 17, the touching pads 121, and the welding pads 122.

Moreover, at least one hole 113 is inwardly formed on the first surface 11 of the circuit board 1, and the circuit board 1 has at least one conductive extension 114 (as shown in FIG. 12) arranged in the at least one hole 113 and connected to the grounding layer 18. The hole 113 in the instant embodiment is formed to penetrate the first surface 11 and the second surface 12, and the conductive extension 114 is coated on the inner wall for defining the hole 113, but the instant disclosure is not limited thereto. For example, in a non-shown embodiment, the hole 113 can be a blind hole.

The connecting clip 2 further has at least one conductive portion 24 perpendicularly connected to one of the two clamping sheets 212 and arranged between the two clamping sheets 212. The conductive portion 24 is inserted into the hole 113 of the circuit board 1 and is firmly connected to the conductive extension 114, such that the connecting clip 2 is configured to electrically connect the metallic shielding layers 33 to the grounding layer 18 of the circuit board 1 for forming a common grounding loop and enhancing a high-frequency transmission performance of the cable connector 100. Moreover, the conductive portion 24 in the instant embodiment is a type of press-fit pin and is squeezed into the hole 113, and the conductive portion 24 is compressed by the conductive extension 114 to tightly connect with the conductive extension 24, so a width of the conductive portion 24 is slightly larger than that of the hole 113, but the instant disclosure is not limited thereto. For example, in a non-shown embodiment, the width of the conductive portion 24 can be smaller than that of the hole 113. After the conductive portion 24 is inserted into the hole 113, the hole 113 is filled with a conductive material and then the conductive material is solidified to form the conductive extension 114 for achieving the connection of the conductive portion 24 and the conductive extension 114.

Accordingly, the connecting clip 2 can be fixed on the circuit board 1 by inserting the conductive portion 24 into the hole 113 of the circuit board 1 for further increasing the gripping effect between the connecting clip 2 and the circuit board 1, thereby resisting a shearing force when any conductive cable 3 and the circuit board 1 are pulled against each other.

In addition, the number of the hole 113, the conductive extension 114, the conductive portion 24, or the grounding layer 18 in the instant embodiment is one, but not limited thereto. For example, in a non-shown embodiment, the circuit board 1 can be provided with a plurality of holes 113, a plurality of conductive extensions 114, and a plurality of grounding layers 18. The connecting clip 2 can be provided with a plurality of conductive portions 24 respectively connected to the two clamping sheets 212.

[Third Embodiment]

Figure 13:
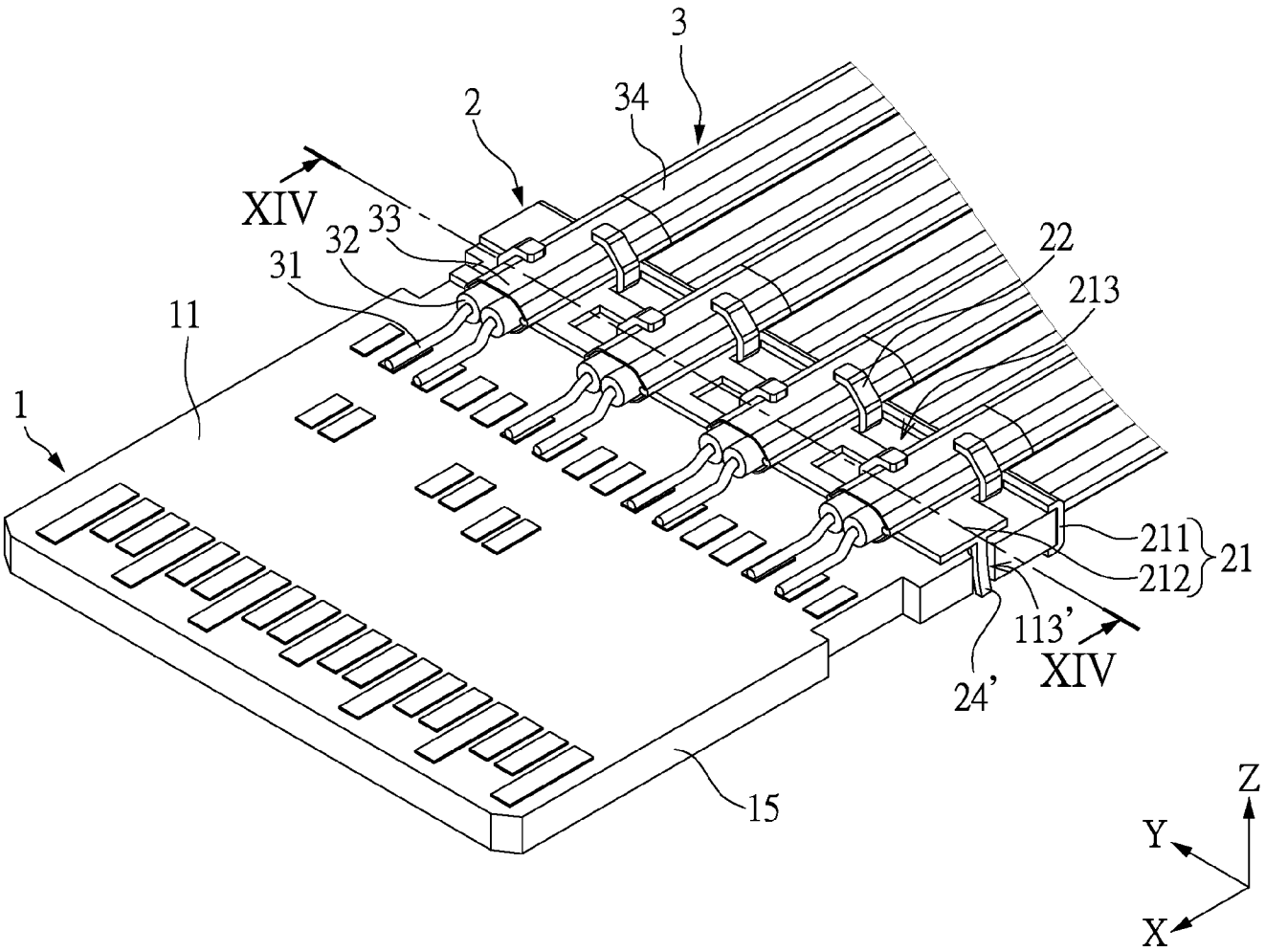
FIG. 13 is a perspective view showing a cable connector according to a third embodiment of the instant disclosure.
Figure 14:
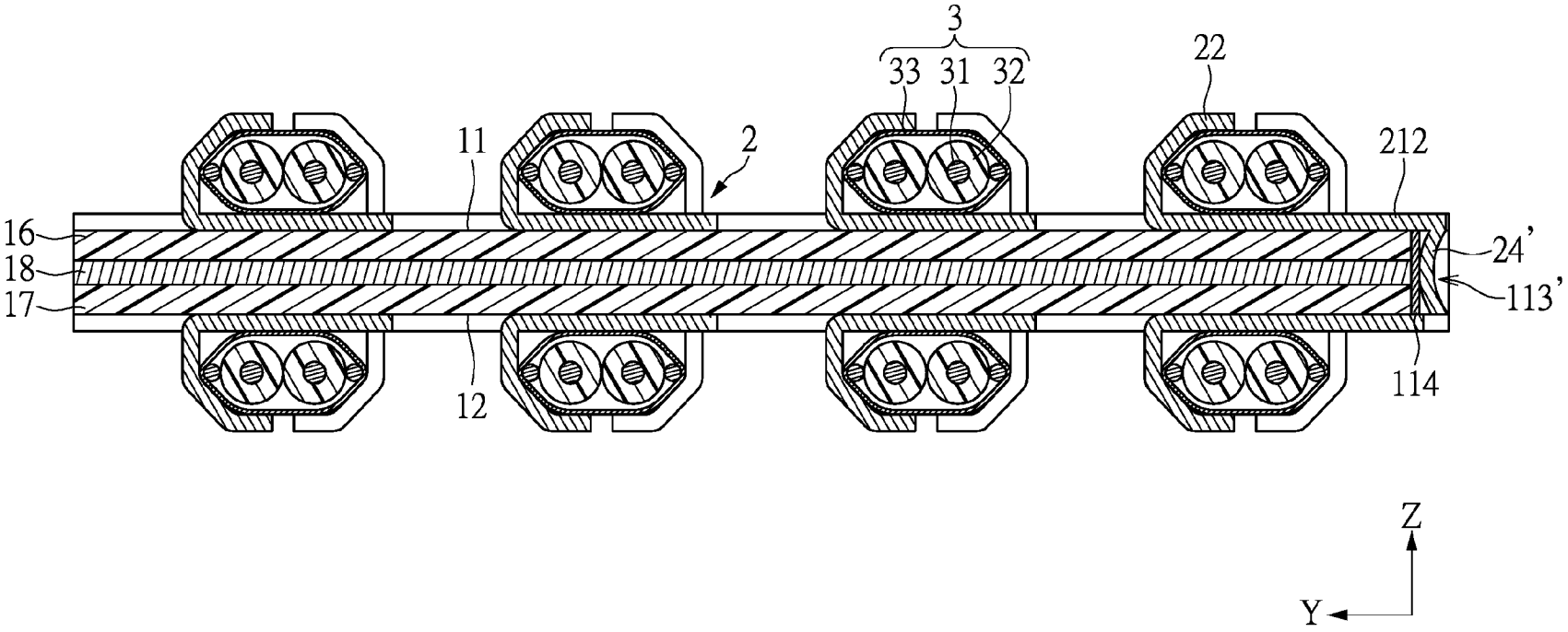
FIG. 14 is a cross-sectional view of FIG. 13 along a cross-sectional line XIV-XIV.

Please refer to FIGS. 13 and 14, which show a third embodiment. The third embodiment is similar to the first and second embodiments, and the different features of the third embodiment compared to the first and second embodiments are the construction of the connecting clip 2 and the corresponding portion of the circuit board 1.

Specifically a hole 113' is inwardly formed on one of the side edges 15 of the circuit board 1 penetrating through the circuit board 1 from the first surface 11 to the second surface 12. The circuit board 1 has a conductive extension 114 coated on an inner wall defining the hole 113'. The connecting clip 2 has a conductive portion 24' curvedly extended from one of the clamping sheets 212, and the conductive portion 24' is formed as an elastic arm. The conductive portion 24' of the connecting clip 2 is inserted into the hole 113' of the circuit board 1 and abuts against the conductive extension 114 arranged in the hole 113'.

[Fourth Embodiment]

Figure 15:
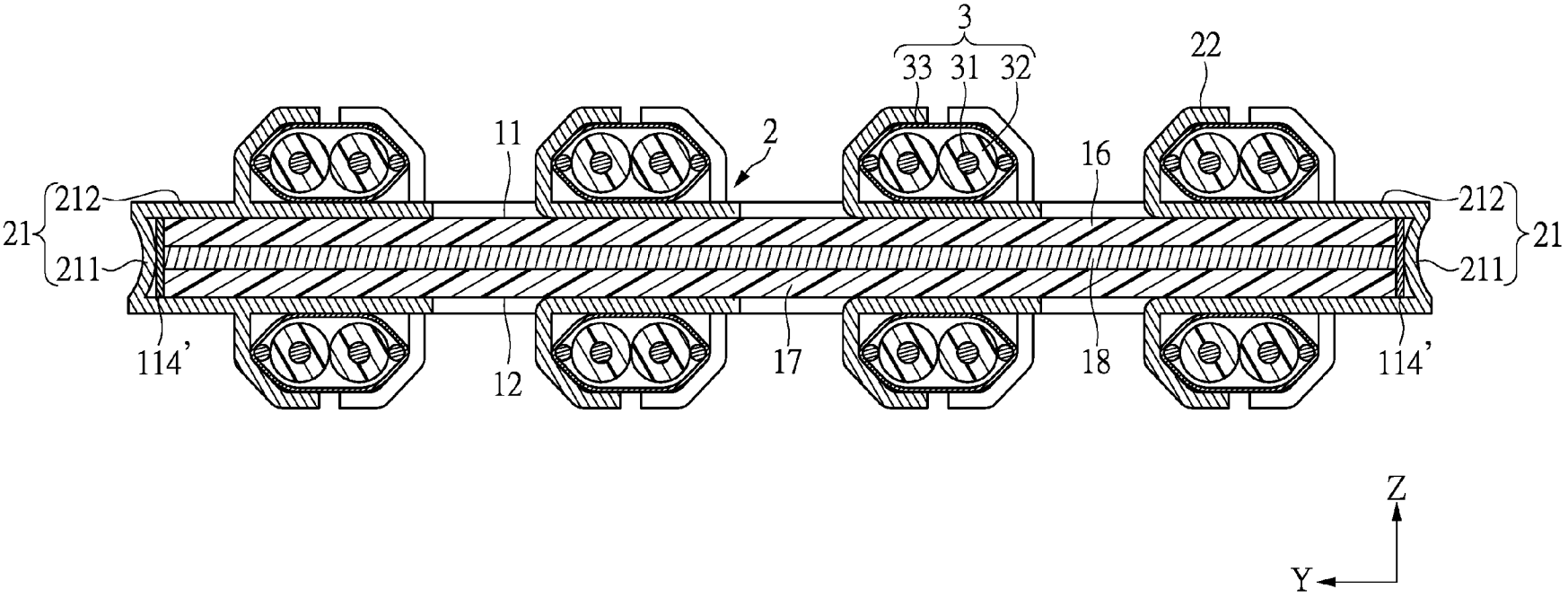
FIG. 15 is a cross-sectional view showing a cable connector according to a fourth embodiment of the instant disclosure.

Please refer to FIG. 15, which shows a fourth embodiment. The fourth embodiment is similar to FIG. 9 of the first embodiment (i.e., the connecting clip 2 in the fourth embodiment is similar to the connecting clip 2 shown in FIG. 9) and the third embodiment (i.e., the circuit board 1 in the fourth embodiment is similar to the circuit board 1 shown in FIGS. 13 and 14). The different features of the fourth embodiment compared to the first and third embodiments are disclosed as follows.

Specifically, the circuit board 1 has two conductive extensions 114' arranged at the two side edges 15 and connected to the grounding layer 18. That is to say, the conductive extensions 114' are not arranged in any hole of the circuit board 1. The connecting clip 2 has two connecting sheets 211, and the inner surfaces of the two connecting sheets 211 are configured to respectively face the two side edges 15 of the circuit board 1. Two opposite ends of one of the connecting sheets 211 (i.e., the top end and the bottom end of the left connecting sheet 211 shown in FIG. 15) are respectively connected to the ends of the two clamping sheets 212 (i.e., the left ends of the two clamping sheets 212 shown in FIG. 15), and two opposite ends of the other connecting sheet 211 (i.e., the top end and the bottom end of the right connecting sheet 211 shown in FIG. 15) are respectively connected to the other ends of the two clamping sheets 212 (i.e., the right ends of the two clamping sheets 212 shown in FIG. 15). Each connecting sheet 211 is bent inwardly to form as an elastic arm, and the two connecting sheets 211 respectively abut against the two conductive extensions 114' of the circuit board 1.

[The Possible Effect of the Instant Embodiments]

In summary, the connecting clip of the instant disclosure is fixed on the circuit board by a clamping force generated from the construction thereof, so the connection of the circuit board and the connecting clip can effectively resist a shearing force when any conductive cable and the circuit board are pulled. Furthermore, the connecting clip can be fixed on the circuit board by inserting the conductive portion into the hole of the circuit board for further increasing the gripping effect between the connecting clip and the circuit board, thereby resisting a shearing force when any conductive cable and the circuit board are pulled.

Moreover, the connecting clip is configured to electrically connect the metallic shielding layers of the conductive cables to each other and to electrically connect the metallic shielding layers to the grounding layer of the circuit board by the cooperation of the conductive portion and the conductive extension, thereby forming a common grounding loop and enhancing a high-frequency transmission performance of the cable connector.

In addition, the construction of the cable connector in the instant disclosure is formed by using the connecting clip to clamp the circuit board and then the conductive cables are respectively arranged adjacent to the positioning arms, so that the carrier module of the instant embodiment can provide a better positioning effect for the conductive cables.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A cable connector, comprising:

a circuit board having a first surface and an opposite second surface;

a connecting clip clamping the circuit board and comprising:

a clamping portion including a connecting sheet and two flat clamping sheets extended from the connecting sheet, wherein the circuit board is sandwiched between the two flat clamping sheets, and the two flat clamping sheets respectively abut against the first surface and the second surface of the circuit board, the two flat clamping sheets each having a flat inner surface, inner surfaces of the two flat clamping sheets abut against the first surface and the second surface of the circuit board respectively; and a plurality of positioning arms respectively formed on the two flat clamping sheets and protruding from the two flat clamping sheets in a direction away from the circuit board; and a plurality of conductive cables each comprising:

a metallic wire having an exposed segment and an embedded segment;

an isolation layer covering the embedded segment;

a metallic shielding layer covering the isolation layer, wherein the exposed segment is arranged out of the isolation layer and the metallic shielding layer;

wherein the exposed segments of the conductive cables are respectively fixed on the first surface and the second surface, the metallic shielding layers of the conductive cables are respectively abutted against the two flat clamping sheets and are respectively positioned with the positioning arms, and the connecting clip is configured to electrically connect the metallic shielding layers to each other.

2. The cable connector as claimed in claim 1, wherein the two flat clamping sheets have a plurality of inner walls respectively defining a plurality of notches, and the positioning arms are respectively and curvedly extended from the inner walls of the two flat clamping sheets.

3. The cable connector as claimed in claim 2, wherein the positioning arms connected to each of the two flat clamping sheets are arranged in two parallel rows.

4. The cable connector as claimed in claim 3, wherein on each of the two flat clamping sheets, one of the two rows of the positioning arms is respectively corresponding to the other row of the positioning arms, and any two corresponding positioning arms arranged in different rows clamp one of the metallic shielding layers.

5. The cable connector as claimed in claim 3, wherein on each of the two flat clamping sheets, one of the two rows of the positioning arms is curvedly extended from the corresponding inner walls in a first direction, and the other row of the positioning arms is curvedly extended from the corresponding inner walls in a second direction opposing to the first direction.

6. The cable connector as claimed in claim 1, wherein the circuit board has a rear edge and two side edges arranged at two opposite sides thereof, an inner surface of the connecting sheet is arranged to face the rear edge or one of the two side edges of the circuit board.

7. The cable connector as claimed in claim 1, wherein an inner surface of the connecting sheet and the inner surfaces of the two flat clamping sheets entirely abut against an outer surface of the circuit board.

8. The cable connector as claimed in claim 1, wherein the connecting clip is configured without welding to each of the first surface or the second surface of the circuit board.

9. The cable connector as claimed in claim 1, wherein the connecting clip has at least one conductive portion perpendicularly connected to one of the two flat clamping sheets and arranged between the two flat clamping sheets.

10. The cable connector as claimed in claim 9, wherein at least one hole is formed on the first surface of the circuit board, the circuit board has a first insulating layer, a second insulating layer, a grounding layer arranged between the first insulating layer and the second insulating layer, and at least one conductive extension arranged in the at least one hole and connected to the grounding layer.

11. The cable connector as claimed in claim 10, wherein the at least one conductive portion is positioned in the at least one hole of the circuit board and is connected to the at least one conductive extension, and the connecting clip is configured to electrically connect the metallic shielding layers to the grounding layer of the circuit board.

12. A carrier module of a cable connector, comprising:

a circuit board having a first surface and an opposite second surface; and a connecting clip clamping the circuit board and comprising:

a clamping portion including a connecting sheet and two flat clamping sheets extended from the connecting sheet, wherein the circuit board is sandwiched between the two flat clamping sheets, and the two flat clamping sheets respectively abut against the first surface and the second surface of the circuit board, the two flat clamping sheets each having a flat inner surface, inner surfaces of the two flat clamping sheets abut against the first surface and the second surface of the circuit board respectively; and a plurality of positioning arms respectively formed on the two flat clamping sheets and protruding from the two flat clamping sheets in a direction away from the circuit board, wherein the positioning arms are configured to position with a plurality of conductive cables provided on the two flat clamping sheets.

13. The carrier module of the cable connector as claimed in claim 12, wherein the two flat clamping sheets have a plurality of inner walls respectively defining a plurality of notches, and the positioning arms are respectively and curvedly extended from the inner walls of the two flat clamping sheets.

14. The carrier module of the cable connector as claimed in claim 12, wherein the positioning arms connected to each of the two flat clamping sheets are arranged in two parallel rows.

15. The carrier module of the cable connector as claimed in claim 14, wherein on each of the two flat clamping sheets, one of the two rows of the positioning arms is respectively corresponding to the other row of the positioning arms, and any two corresponding positioning arms arranged in different rows are configured to clamp one of the conductive cables.

16. The carrier module of the cable connector as claimed in claim 12, wherein an inner surface of the connecting sheet and the inner surfaces of the two flat clamping sheets entirely abut against an outer surface of the circuit board.

17. The carrier module of the cable connector as claimed in claim 12, wherein the connecting clip is configured without welding to each of the first surface or the second surface of the circuit board.

* * * * *